United States Patent [19]

Ellis, III

[11] Patent Number: 4,989,349

[45] Date of Patent: Feb. 5, 1991

[54] SHOE WITH CONTOURED SOLE

[76] Inventor: Frampton E. Ellis, III, 2895 S. Abingdon St., Suite B-2, Arlington, Va. 22206

[21] Appl. No.: 492,360

[22] Filed: Mar. 9, 1990

Related U.S. Application Data

[63] Continuation of Ser. No. 219,387, Jul. 15, 1988, abandoned.

[51] Int. Cl.[5] ..... A43B 13/14

[52] U.S. Cl. ..... 36/25 R; 36/59 C

[58] Field of Search ..... 36/25 R, 31, 59 C, 59 R, 36/88, 103, 129

[56] References Cited

U.S. PATENT DOCUMENTS

| | | | |
|---|---|---|---|
| 288,127 | 11/1983 | Shepard | 36/32 R |
| 1,289,106 | 12/1918 | Bullock | 36/59 C |
| 3,308,560 | 3/1967 | Jones | 36/59 R |
| 4,083,125 | 4/1978 | Benseler | 36/32 R |
| 4,128,951 | 12/1978 | Tansill | 36/88 |
| 4,141,158 | 2/1979 | Benseler | 36/32 R |
| 4,449,306 | 5/1984 | Cavanaugh | 36/30 |
| 4,557,059 | 12/1985 | Misevich et al. | 36/32 |

FOREIGN PATENT DOCUMENTS

| | | | |
|---|---|---|---|
| 0185781 | 12/1984 | European Pat. Off. . | |
| B23257 | 5/1953 | Fed. Rep. of Germany . | |
| 1290844 | 3/1969 | Fed. Rep. of Germany | 36/32 R |
| 602501 | 3/1926 | France | 36/31 |
| 1004472 | 3/1952 | France | 36/59 C |
| 59-23525 | 7/1984 | Japan | 36/25 R |
| 2136670 | 9/1984 | United Kingdom . | |

OTHER PUBLICATIONS

Benno M. Nigg and M. Morlock, "The Influence of Lateral Heel Flare of Running Shoes on Pronation and Impact Forces", *Medicine and Science in Sports and Exercise,* vol. 19, No. 3 (1987), pp. 294–302.

*Primary Examiner*—Werner H. Schroeder
*Assistant Examiner*—Diana L. Biefeld
*Attorney, Agent, or Firm*—Ronald P. Kananen

[57] ABSTRACT

A construction for a shoe, particularly an athletic shoe such as a running shoe, includes a sole having a load-bearing sole portion and a contoured edge stability portion. The edge portion of the sole is contoured and defined by an arc of a circle having a radius equal to the thickness of the sole portion of the sole and its center at a point lying on the plane of the upper surface of the sole thickness. However, the contour varies as the thickness of the sole portion varies due to heel lift, for example. Thus, the outer contour of the edge portion of the sole has at least a portion which lies along a theoretically ideal stability plane for providing natural stability and efficient motion of the shoe and foot in an inverted and everted mode.

54 Claims, 13 Drawing Sheets

FIG. 1
(PRIOR ART)
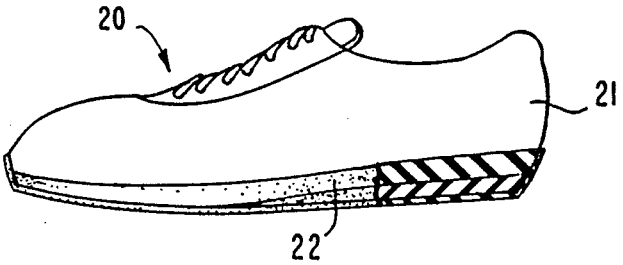
FIG. 2A
(PRIOR ART)
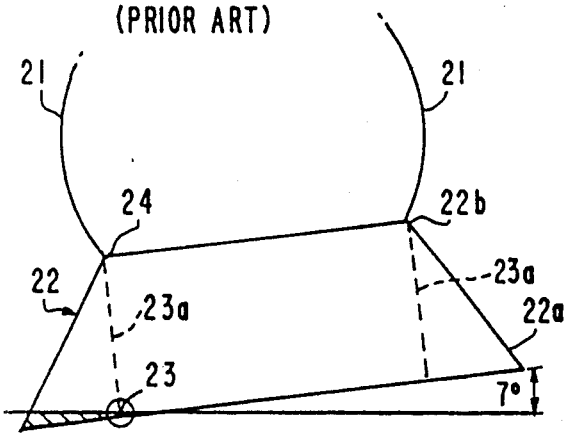
FIG. 2
FIG. 2B
(PRIOR ART)
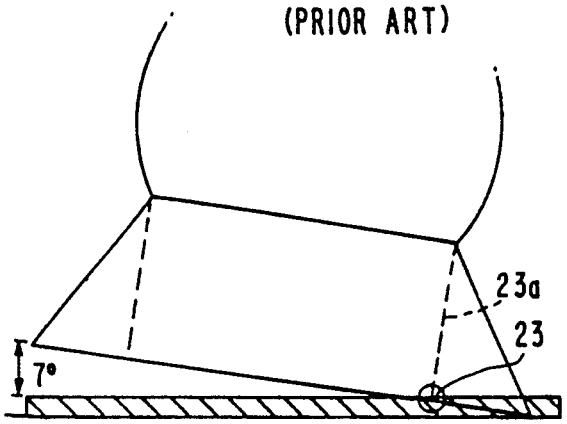
FIG. 2C
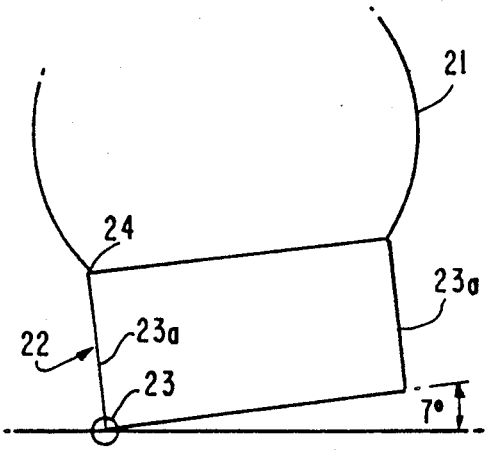
FIG. 2D
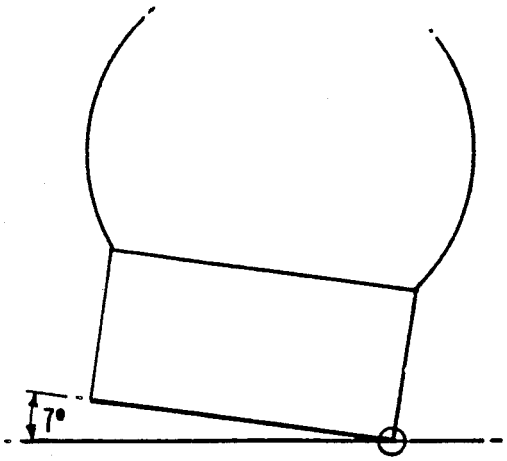

SHOE WITH CONTOURED SOLE

This application is a continuation of application Ser. No. 07/219,387, filed July 15, 1988.

BACKGROUND OF THE INVENTION

This invention relates to a shoe, such as a street shoe, athletic shoe, and especially a running shoe with a contoured sole. More particularly, this invention relates to a novel contoured sole design for a running shoe which improves the inherent stability and efficient motion of the shod foot in extreme exercise. Still more particularly, this invention relates to a running shoe wherein the outer extremity of the sole includes precisely-contoured quadrant or quasi quadrant portions permitting the foot to react naturally with the ground as it would if the foot were bare, while continuing to protect and cushion the foot.

By way of introduction, barefoot populations universally have a very low incidence of running "overuse" injuries, despite very high activity levels. In contrast, such injuries are very common in shoe shod populations, even for activity levels well below "overuse". Thus, it is a continuing problem with a shod population to reduce or eliminate such injuries and to improve the cushioning and protection for the foot. It is primarily to an understanding of the reasons for such problems and to proposing a novel solution according to the invention to which this improved shoe is directed.

A wide variety of designs are available for running shoes which are intended to provide stability, but which lead to a constraint in the natural efficient motion of the foot and ankle. However, such designs which can accommodate free flexible motion in contrast create a lack of control or stability. A popular existing shoe design incorporates an inverted, outwardly-flared shoe sole wherein the ground engaging surface is wider than the heel engaging portion. However, such shoes are unstable in extreme situations because the shoe sole, when inverted or on edge, immediately becomes supported only by the sharp bottom sole edge where the entire weight of the body, multiplied by a factor of approximately three at running peak, is concentrated. Since an unnatural lever arm and force moment are created under such conditions, the foot and ankle are destabilized and, in the extreme, beyond a certain point of rotation about the pivot point of the shoe sole edge, forceably cause ankle strain. In contrast, the unshod foot is always in stable equilibrium without a comparable lever arm or force moment and, at its maximum range of inversion motion, about 20°, the base of support on the barefoot heel actually broadens substantially as the calcaneal tuberosity contacts the ground. This is in contrast to the conventionally available shoe sole bottom which maintains a sharp, unstable edge.

It is thus an overall objective of this invention to provide a novel shoe design which approximates the barefoot. It has been discovered, by investigating the most extreme range of ankle motion to near the point of ankle sprain, that the abnormal motion of an inversion ankle sprain, which is a tilting to the outside or an outward rotation of the foot, is accurately simulated while stationary. With this observation, it can be seen that the extreme range stability of the conventionally shod foot is distinctly inferior to the barefoot and that the shoe itself creates a gross instability which would otherwise not exist.

Even more important, a normal barefoot running motion, which approximately includes a 7° inversion and a 7° eversion motion, does not occur with shod feet, where a 30° inversion and eversion is common. Such a normal barefoot motion is geometrically unattainable because the average running shoe heel is approximately 60% larger than the width of the human heel. As a result, the shoe heel and the human heel cannot pivot together in a natural manner; rather, the human heel has to pivot within the shoe but is resisted from doing so by the shoe heel counter, motion control devices, and the lacing and binding of the shoe upper, as well as various types of anatomical supports interior to the shoe.

Thus, it is an overall objective to provide an improved shoe design which is not based on the inherent contradiction present in current shoe designs which make the goals of stability and efficient natural motion incompatible and even mutually exclusive. It is another overall object of the invention to provide a new contour design which simulates the barefoot in running and thus avoids the inherent contradictions in current designs.

It is another objective of this invention to provide a running shoe which overcomes the problem of the prior art.

It is another objective of this invention to provide a shoe wherein the outer extent of the sole of the shoe includes all of the support structures of the foot but which extends no further than the outer edge of the shoe sole so that the transverse or horizontal plane outline of the top of the shoe sole coincides as nearly as possible with the load-bearing portion of the foot sole.

It is another objective of the invention to provide a shoe having a sole which includes a rounded sole edge contoured like the natural form of the side or edge of the human foot but in a geometrically precise manner so that the shoe sole thickness is precisely constant, even if the shoe sole is tilted to either side, or forward or backward.

It is another objective of this invention to provide a novel shoe structure in which the contoured sole includes at its outer edge portions a contoured surface described by a radius equal to the thickness of the shoe sole with a center of rotation at the outer edge of the top of the shoe sole.

It is another objective of this invention to provide a sole structure of the type described which includes at least portions of outer edge quadrants wherein the outer edge of each quadrant coincide with the horizontal plane of the top of the sole while the other edge is perpendicular to it.

It is still another objective of this invention to provide a new stable shoe design wherein the heel lift or wedge increases the thickness of the shoe sole or toe taper decrease therewith so that the side quadrants also increase or decrease by exactly the same amount so that the radius of the side quadrant is always equal to the constant thickness of the shoe sole in a frontal planar cross section.

These and other objectives of the invention will become apparent from a detailed description of the invention which follows taken in conjunction with the accompanying drawings.

BRIEF DESCRIPTION OF THE DRAWINGS

In the drawings:

FIG. 1 is a perspective view of a typical running shoe known to the prior art to which the invention is applicable;

FIG. 2 shows, in FIGS. 2A and 2B, the obstructed natural motion of the shoe heel in frontal planar cross section rotating inwardly or outwardly with the shoe sole having a flared bottom in a conventional prior art design such as in FIG. 1; and in FIGS. 2C and 2D, the efficient motion of a narrow rectangular shoe sole design;

FIG. 7D is a top view of the shoe sole shown in FIG. 6, wherein

DETAILED DESCRIPTION OF THE PREFERRED EMBODIMENT

Figure 3A:
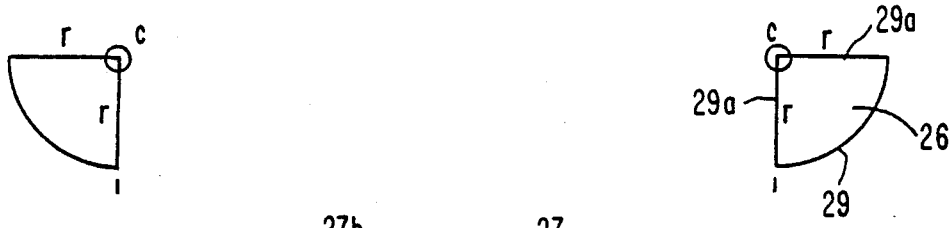
FIG. 3 is a diagrammatic chart showing, in FIGS. 3A–3C, the outer contoured sides related to the sole of the novel shoe design according to the invention.

A perspective view of an athletic shoe, such as a typical running shoe, according to the prior art, is shown in FIG. 1 wherein a running shoe 20 includes an upper portion 21 and a sole 22. Typically, such a sole includes a truncated outwardly flared construction of the type best seen in FIG. 2 wherein the lower portion 22*a* of the sole heel is significantly wider than the upper portion 22*b* where the sole 22 joins the upper 21. A number of alternative sole designs are known to the art, including the design shown in U.S. Pat. No. 4,449,306 to Cavanagh wherein an outer portion of the sole of the running shoe includes a rounded portion having a radius of curvature of about 20 mm. The rounded portion lies along approximately the rear-half of the length of the outer side of the mid-sole and heel edge areas wherein the remaining border area is provided with a conventional flaring with the exception of a transition zone. The U.S. Patent to Misevich, No. 4,557,059 also shows an athletic shoe having a contoured sole bottom in the region of the first foot strike, in a shoe which otherwise uses an inverted flared sole.

In such prior art designs, and especially in athletic and in running shoes, the typical design attempts to achieve stability by flaring the heel as shown in FIGS. 2A and 2B to a width of, for example, 3 to 3½ inches on the bottom outer sole 22*a* of the average male shoe size (10D). On the other hand, the width of the corresponding human heel foot print, housed in the upper 21, is only about 2.25 in. for the average foot. Therefore, a mismatch occurs in that the heel is locked by the design into a firm shoe heel counter which supports the human heel by holding it tightly and which may also be reenforced by motion control devices to stabilize the heel. Thus, for natural motion as is shown in FIGS. 2A and 2B, the human heel would normally move in a normal range of motion of approximately 15°, but as shown in FIGS. 2A and 2B the human heel cannot pivot except within the shoe and is resisted by the shoe. Thus, FIG. 2A illustrates the impossibility of pivoting about the center edge of the human heel as would be conventional for barefoot support about a point 23 defined by a line 23*a* perpendicular to the heel and intersecting the edge heel 21 at a point 24. The lever arm force moment of the flared sole is at a maximum at 0° and only slightly less at a normal 7° inversion or eversion and thus strongly resists such a natural motion as is illustrated in FIGS. 2A and 2B. In FIG. 2A, the outer edge of the heel must compress to accommodate such motion. FIG. 2B illustrates that normal natural motion of the shoe is inefficient in that the center of gravity of the shoe, and the shod foot, is forced upperwardly, as discussed later in connection with FIG. 14.

A narrow rectangular shoe sole design of heel width approximating human heel width is also known and is shown in FIGS. 2C and 2D. It appears to be more efficient than the conventional flared sole shown in FIGS. 2A and 2B. Since the shoe sole width is the same as human sole width, the shoe can pivot naturally with the normal 7° inversion/eversion motion of the running barefoot. In such a design, the lever arm length and the vertical motion of the center of gravity are approximately half that of the flared sole at a normal 7° inversion/eversion running motion. However, the narrow, human heel width rectangular shoe design is extremely unstable and therefore prone to ankle sprain, so that it has not been well received. Thus, neither of these wide or narrow designs has proved satisfactory.

Figure 3B:
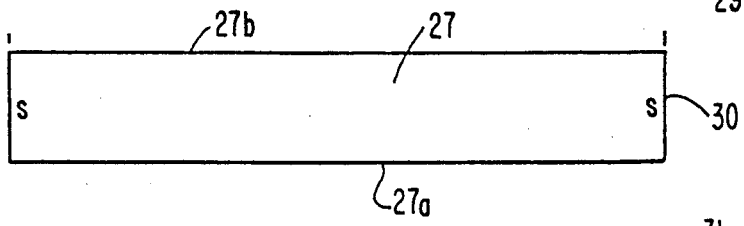
Figure 3C:
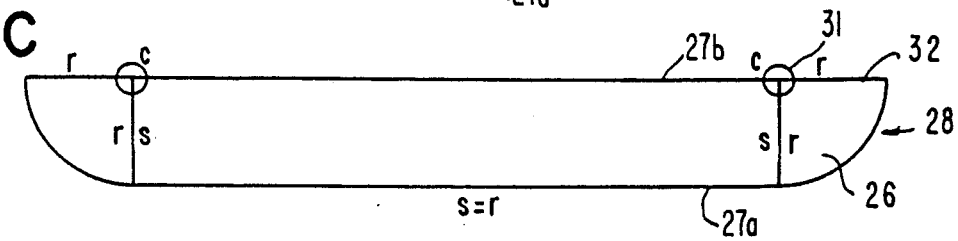

FIG. 3 illustrates in frontal plane cross section a significant element of the applicant's shoe design in its use of stabilizing quadrants 26 at the outer edge of a shoe sole 27 illustrated generally at the reference numeral 28. It is thus a main feature of the applicant's invention to eliminate the unnatural sharp bottom edge, especially of flared shoes, in favor of a rounded shoe sole edge 29 as shown in FIG. 3. The side or edge 29 of the shoe sole 28 is contoured much like the natural form on the side or edge of the human foot, but in a geometrically precise manner to follow a theoretically ideal stability plane. According to the invention, the thickness (s) of the shoe sole 28 is maintained exactly constant, even if the shoe sole is tilted to either side, or forward or backward. Thus, the side stabilizing quadrants 26, according to the applicant's invention, are defined by a radius 29*a* which is the same as the thickness 30 of the shoe sole 27 so that, in cross section, the shoe sole comprises a stable shoe sole 28 having at its outer edges quadrants 26 a surface 29 representing a portion of a theoretically ideal stability plane and described by a radius 29*a* equal to the thickness (s) of the sole and a quadrant center of rotation at the outer edge 31 at the top of the shoe sole 27*b*, which coincides with the shoe wearer's load-bearing footprint. An outer edge 32 of the quadrant 26 coincides with the horizontal plane of the top of the shoe sole 27, while the other edge of the quadrant 26 is perpendicular to the edge 32 and coincides with the perpendicular sides 30 of the shoe sole 27. In practice, the shoe sole 28 is preferably integrally formed from the portions 27 and 26. The outer edge 32 may also extend to lie at an angle relative to the sole upper surface. Thus, the theoretically ideal stability plane includes the contours 29 merging into the lower surface 27*a* of the sole 27.

Figure 4B:
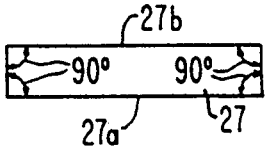
FIG. 4 shows a preferred shoe sole periphery when using the sole of the invention.
Figure 4A:
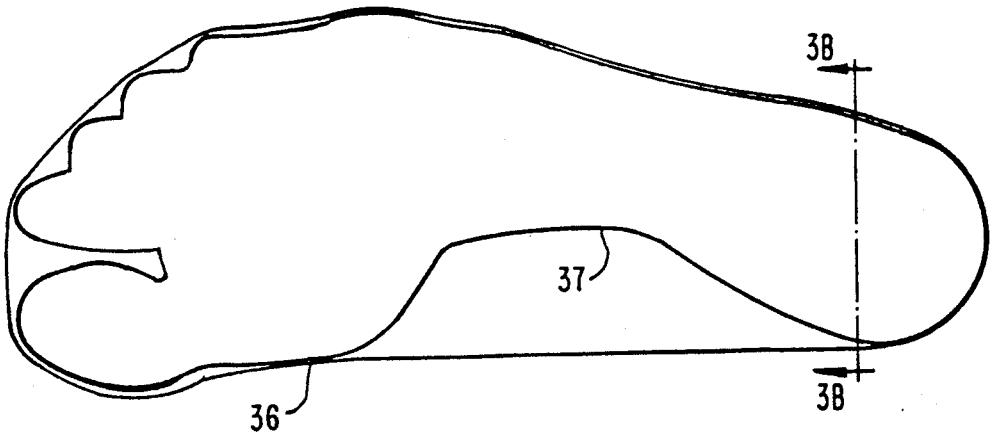
Figure 6:
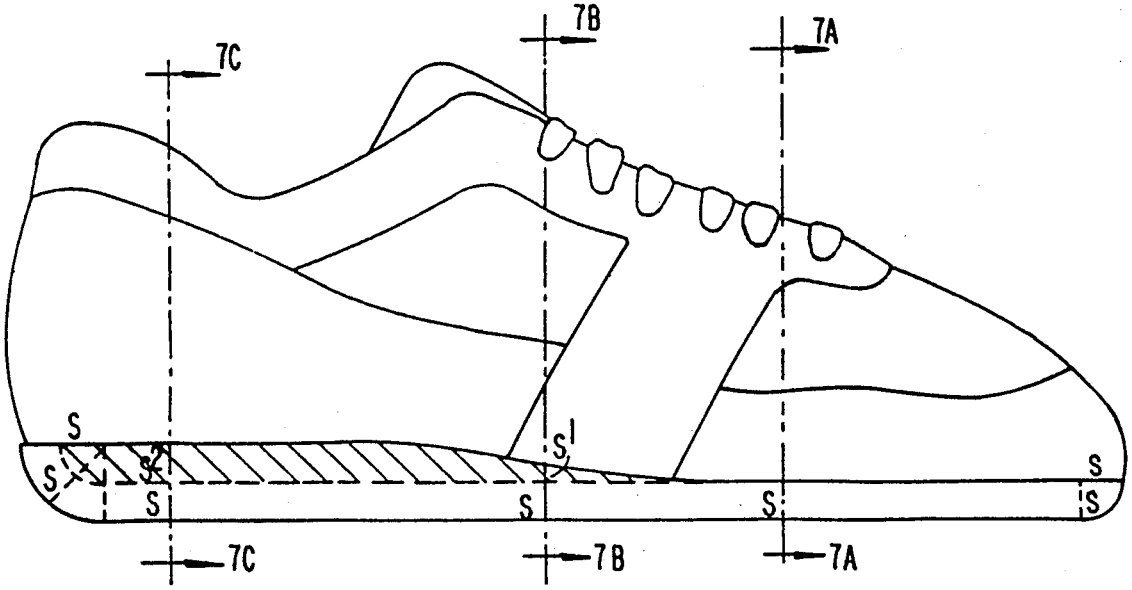
FIG. 6 is a side view of the novel stable contoured shoe according to the invention showing the contoured side design.

Preferably, the peripheral extent of the sole 36 of the shoe includes all of the support structures of the foot but extends no further than the outer edge of the foot sole 37 as defined by a load-bearing footprint, as shown in FIG. 4, which is a top view of the upper shoe sole surface 27*b*. FIG. 4 thus illustrates a foot outline at numeral 37 and a recommended sole outline 36 relative thereto. Thus, a horizontal plane outline of the top of the shoe sole should, preferably, coincide as nearly as practicable with the load-bearing portion of the foot sole with which it comes into contact. Such a horizontal outline, as best seen in FIGS. 4 and 6, should remain uniform throughout the entire thickness of the shoe sole eliminating negative or positive sole flare so that the sides are exactly perpendicular to the horizontal plane as shown in FIG. 3B. Preferably, the density of the shoe sole material is uniform.

Figure 5A:
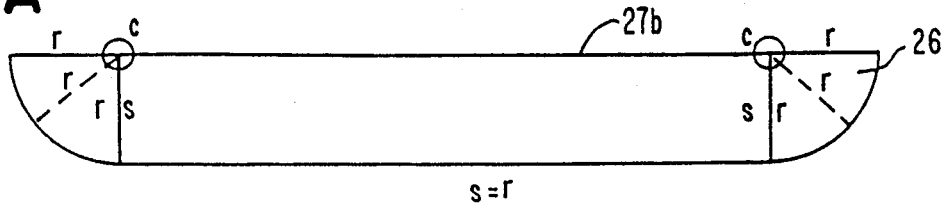
FIG. 5 is diagrammatic sketch in FIGS. 5A and 5B, showing the novel contoured side sole design according to the invention with variable heel lift.

Another significant feature of the applicant's invention is illustrated diagrammatically in FIG. 5. Preferably, as the heel lift or wedge increases the thickness (s) of the shoe sole in an aft direction of the shoe, the side quadrants 26 increase about exactly the same amount according to the principles discussed in connection with FIG. 3. Thus, according to the applicant's design, the radius 29*a* of curvature (r) of the side quadrant is always equal to the constant thickness (s) of the shoe sole in the frontal cross-sectional plane.

Figure 5B:
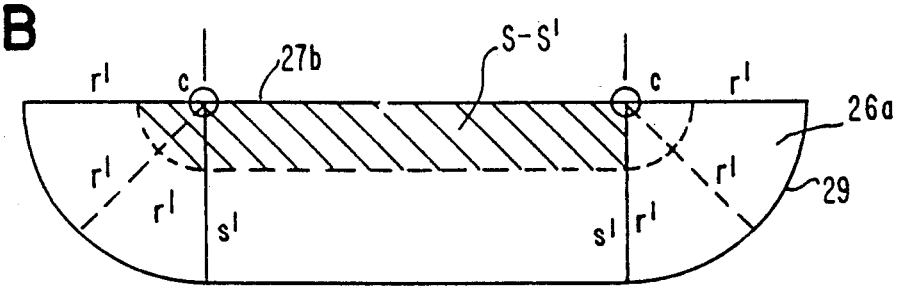

As shown in FIG. 5B, for a shoe that follows a more conventional horizontal plane outline, the sole can be improved significantly according to the applicant's invention by the addition of outer edge quadrant 26 having a radius which correspondingly varies with the thickness of the shoe sole and changes in the frontal plane according to the shoe heel lift. Thus, as illustrated in FIG. 5B, the radius of curvature of the quadrant 26*a* is equal to the thickness s1 of the shoe sole 27 which is thicker than the shoe sole (s) shown in FIG. 5A by an amount equivalent to the heel lift (s-s1). In the generalized case, the radius (r1) of the quadrant is thus always equal to the thickness (s) of the shoe sole.

Figure 7A:
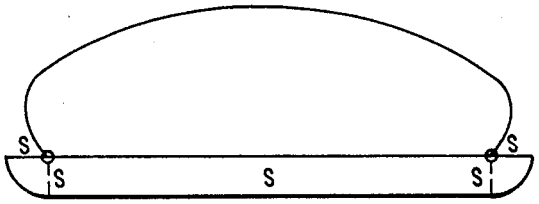
FIG. 7A is a cross-sectional view of the forefoot portion taken along lines 7A of FIGS. 6 or 7D.
Figure 7B:
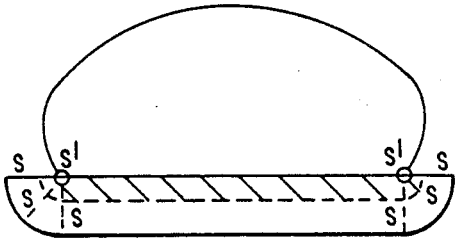
FIG. 7B is a view taken along lines 7B of FIGS. 6 and 7D.
Figure 7C:
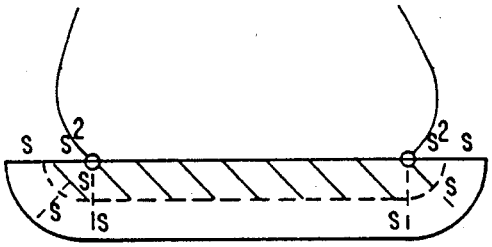
FIG. 7C is a cross-sectional view taken along the heel along lines 7C in FIGS. 6 and 7D.
Figure 7D:
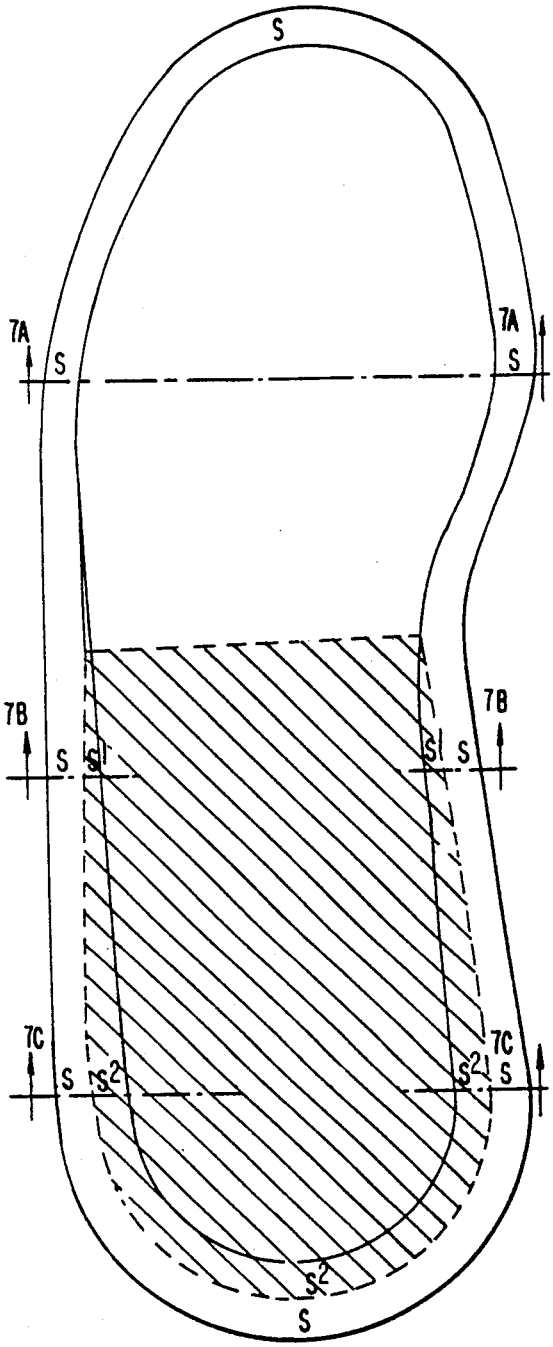

FIG. 6 illustrates a side cross-sectional view of a shoe to which the invention has been applied and is also shown in a top plane view in FIG. 7D. FIGS. 7A, 7B and 7C represent cross-sections taken along the forefoot, at the base of the fifth metatarsal, and at the heel, thus illustrating that the shoe sole thickness is constant at each cross-section and that the radius of curvature of the outer quadrant is equal to the shoe sole thickness at that section. Moreover, in FIG. 7A, it can be seen that the contour of the sole follows the preferred principle in matching, as nearly as practical, the load-bearing sole print shown in FIG. 4.

Figure 8:
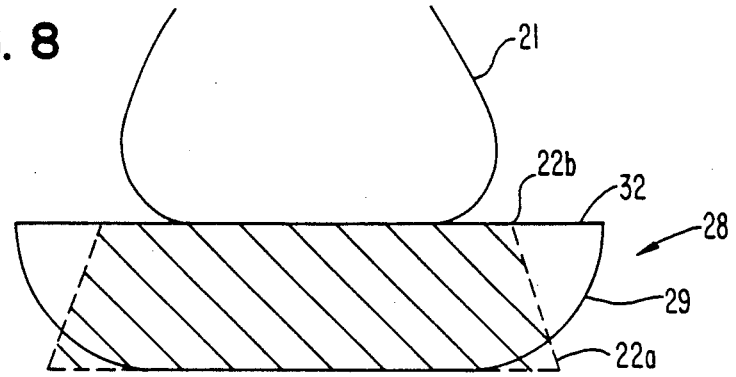
FIG. 8 is a drawn comparison between a conventional flared sole shoe of the prior art and the contoured shoe design according to the invention.

FIG. 8 thus contrasts in frontal plane cross section the conventional flared sole 22 shown in phantom outline and illustrated in FIG. 2 with the contoured shoe sole 28 according to the invention as shown in FIGS. 3–7.

Figure 9A:
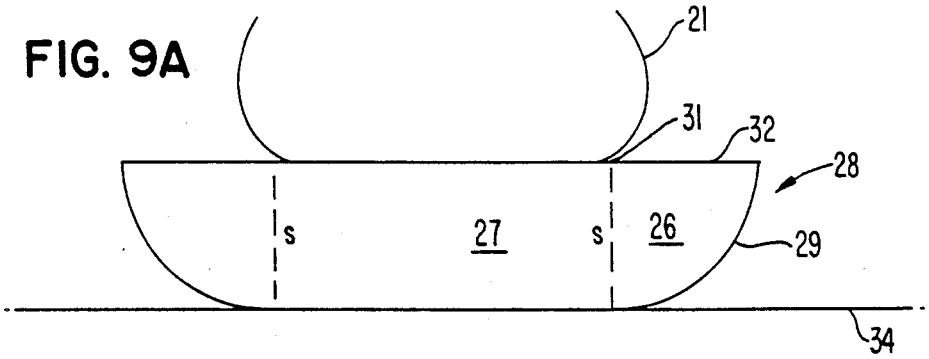
FIG. 9 shows, in FIGS. 9A–9C, the extremely stable conditions for the novel shoe sole according to the invention in its neutral and extreme situations.
Figure 9B:
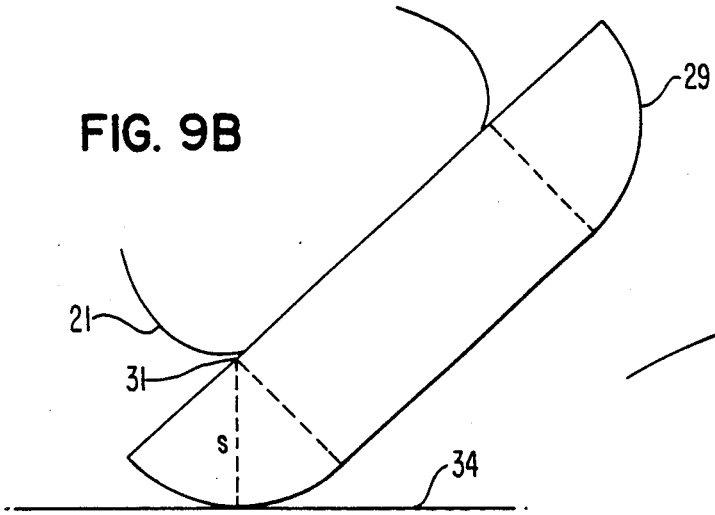
Figure 9C:
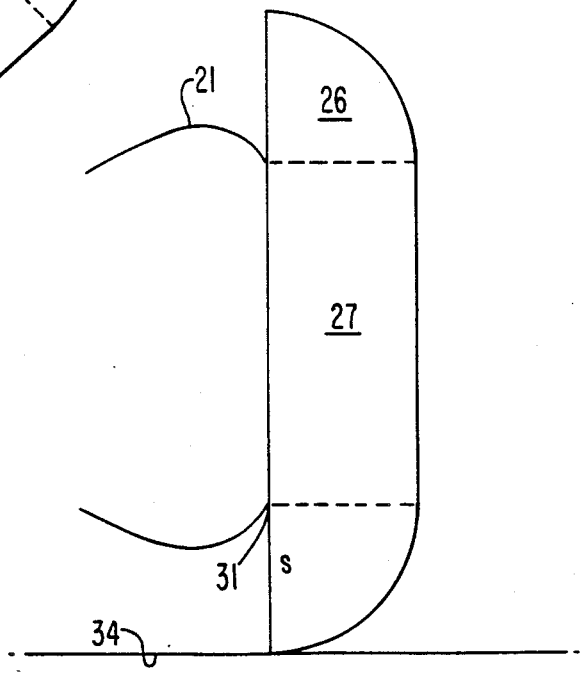

FIG. 9 is suitable for analyzing the shoe sole design according to the applicant's invention by contrasting the neutral situation shown in FIG. 9A with the extreme tilting situations shown in FIGS. 9B and 9C. Unlike the sharp sole edge of a conventional shoe as shown in FIG. 2, the effect of the applicant's invention having a contoured quadrant edge 29 is totally neutral allowing the shod foot to react naturally with the ground 34, in either an inversion or eversion mode. This occurs in part because of the unvarying thickness along the shoe sole edge which keeps the foot sole equidistant from the ground in a preferred case. Moreover, because the shape of the edge 29 of the shoe edge quadrant 26 is roughly like that of the edge of the foot, the shoe is enabled to react naturally with the ground in a manner simulating the foot. Thus, in the neutral position shown in FIG. 9A, the surface of the shoe 27 and the point 31 lie at a distance s from the ground surface 34. That distance s remains constant even for extreme situations as seen in FIGS. 9B and 9C.

A main point of the applicant's invention, as is illustrated in FIGS. 9B and 9C, is that the design shown is stable in an in extremis situation. The ideal plane of stability where the stability plane is defined as sole thickness which is constant under all load-bearing points of the foot sole for any amount from 0° to 90° rotation of the sole to either side or front and back. In other words, as shown in FIG. 9, if the shoe is tilted from 0° to 90° to either side or from 0° to 90° forward or backward representing a 0° to 90° foot dorsiflexion or 0° to 90° plantarflexion, the foot will remain stable because the sole thickness s between the foot and the ground always remain constant because of the exactly contoured quadrant sides. By remaining a constant distance from the ground, the stable shoe allows the foot to react to the ground as if the foot were bare while allowing the foot to be protected and cushioned by the shoe. In its preferred embodiment, the new contoured design assumes that the shoe uppers 21, including heel counters and other motion control devices, will effectively position and hold the foot onto the load-bearing foot print section of the shoe sole.

Figure 10A:
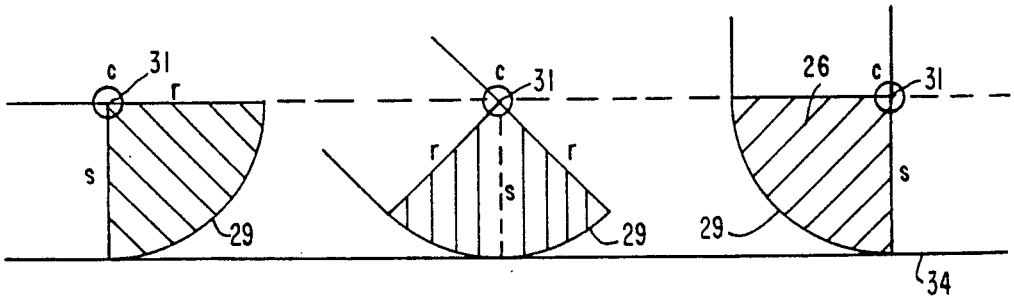
FIG. 10 is a side cross-sectional view of the quadrant sole side showing how the sole maintains a constant distance from the ground during rotation of the shoe edge.
Figure 10B:
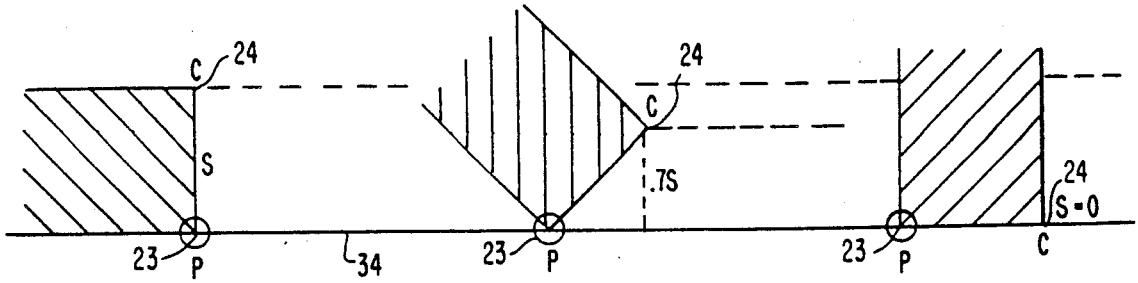
Figure 11A:
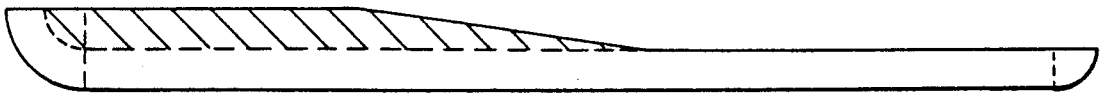
FIG. 11 shows, in FIGS. 11A–11E, a plurality of side sagittal plane cross-sectional views showing examples of conventional sole thickness variations to which the invention can be applied.
Figure 11B:
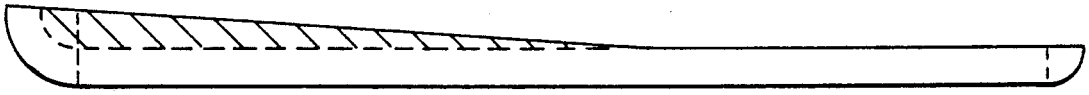
Figure 11C:
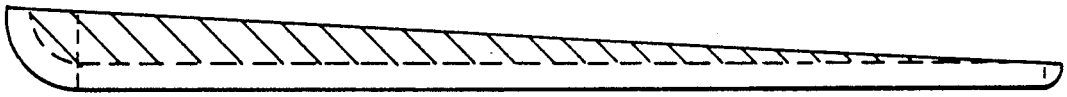
Figure 11D:
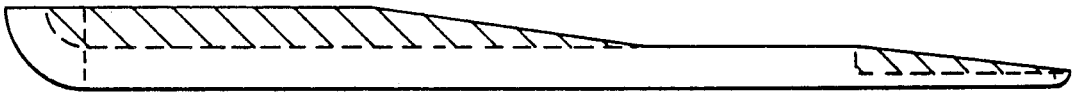
Figure 11E:
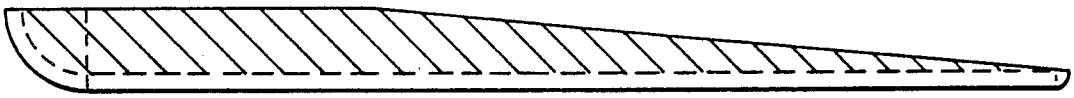

FIG. 10A illustrates how the center of rotation of the quadrant sole side 31 is maintained at a constant distance (s) from the ground through various degrees of rotation of the edge 29 of the shoe sole such as is shown in FIG. 9. FIG. 10B shows how a conventional shoe sole pivots around its lower edge 35, which is its center of rotation, instead of around the upper edge 24, which, as a result, is not maintained at constant distance (s) from the ground, as with the invention, but is lowered to 0.7(s) at 45° rotation and to zero at 90° rotation.

FIG. 11 shows typical conventional sagittal plane shoe sole thickness variations in FIGS. 11A–11E and how the quadrant radius 29 equals and therefore varies with those varying thicknesses as discussed in connection with FIG. 5.

Figure 12A:
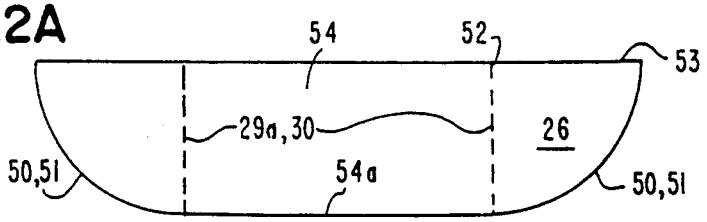
FIG. 12 shows, in FIGS. 12A–12C, frontal plane cross-sectional views of the shoe sole according to the invention showing a theoretically ideal stability plane and truncations of the sole edge quadrant to reduce shoe bulk.
Figure 12B:
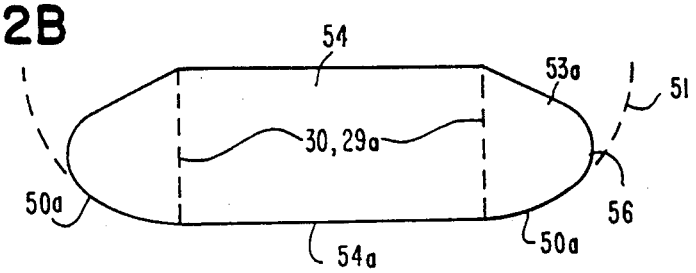
Figure 12C:
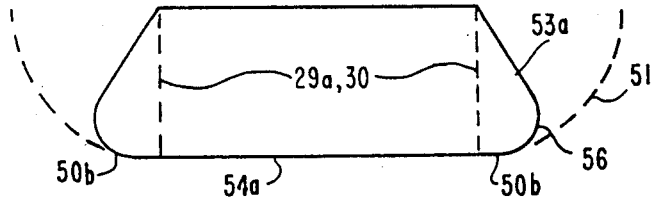

FIG. 12 illustrates an embodiment of the invention which utilizes only a portion of the theoretically ideal stability plane 51 in the quadrants 26 in order to reduce the weight and bulk of the sole, while accepting a sacrifice in some stability of the shoe. Thus, FIG. 12A illustrates the preferred embodiment as described above in connection with FIG. 5 wherein the outer quadrant 50 follows a theoretically ideal stability plane 51 about a center 52 and defines a surface 53 which is coplanar (or at an angle) with the upper surface of the shoe sole 54. As in FIG. 3, the contoured surfaces 50, and the lower surface of the sole 54A lie along the theoretically ideal stability plane. As shown in FIG. 12B, an engineering trade off results in an abbreviation within the ideal stability plane 51 by forming a quadrant surface **53*a* at an angle relative to the upper plane of the shoe sole 54 so that only a portion of the quadrant defined by the radius lying along the surface 50*a* is coplanar with the theoretically ideal stability plane 51. FIG. 12C shows a similar embodiment wherein the engineering trade-off results in a portion 50*b* which lies along the theoretically ideal stability plane 51. The portion 50*b* merges into a second portion 56 which itself merges into the upper surface 53*a*** of the quadrant.

The embodiment of FIG. 12 may be desirable for portions of the shoe sole which are less frequently used so that the additional part of the side is used less frequently. For example, a shoe may typically roll out laterally, in an inversion mode, to about 20° on the order of 100 times for each single time it rolls out to 40°. Yet, the added shoe weight to cover that entire range is about equivalent to covering the limited range. Since, in a racing shoe this weight might not be desirable, an engineering trade-off of the type shown in FIG. 12C is possible.

Figure 13A:
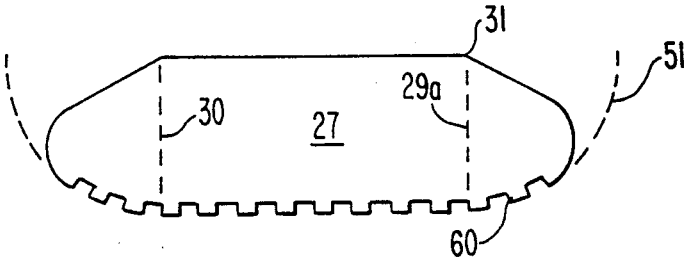
FIG. 13 shows, in FIGS. 13A–13C, the contoured sole design according to the invention when applied to various tread and cleat patterns.
Figure 13B:
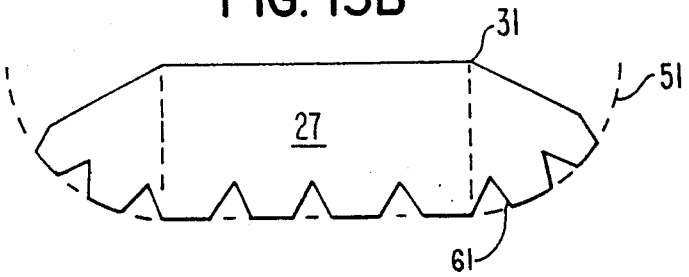
Figure 13C:
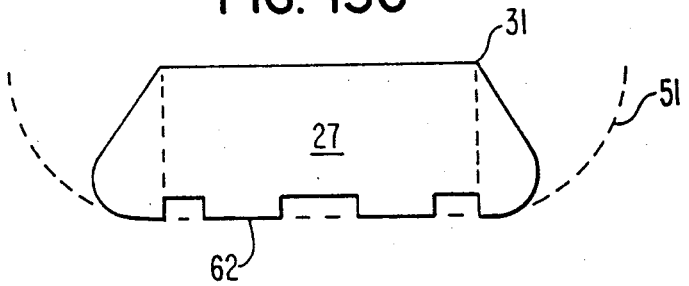

FIG. 13 shows the theoretically ideal stability plane 51 in defining embodiments of the shoe sole having differing tread or cleat patterns. Thus, FIG. 13 illustrates that the invention is applicable to shoe soles having conventional bottom treads. Accordingly, FIG. 13A is similar to FIG. 12B further including a tread portion 60, while FIG. 13B is also similar to FIG. 12B wherein the sole includes a cleated portion 61. The embodiment in FIG. 13C is similar to FIG. 12C showing still an alternative tread construction 62. In each case, the load-bearing outer surface of the tread or cleat pattern 60–62 lies along the theoretically ideal stability plane 51.

Figure 14:
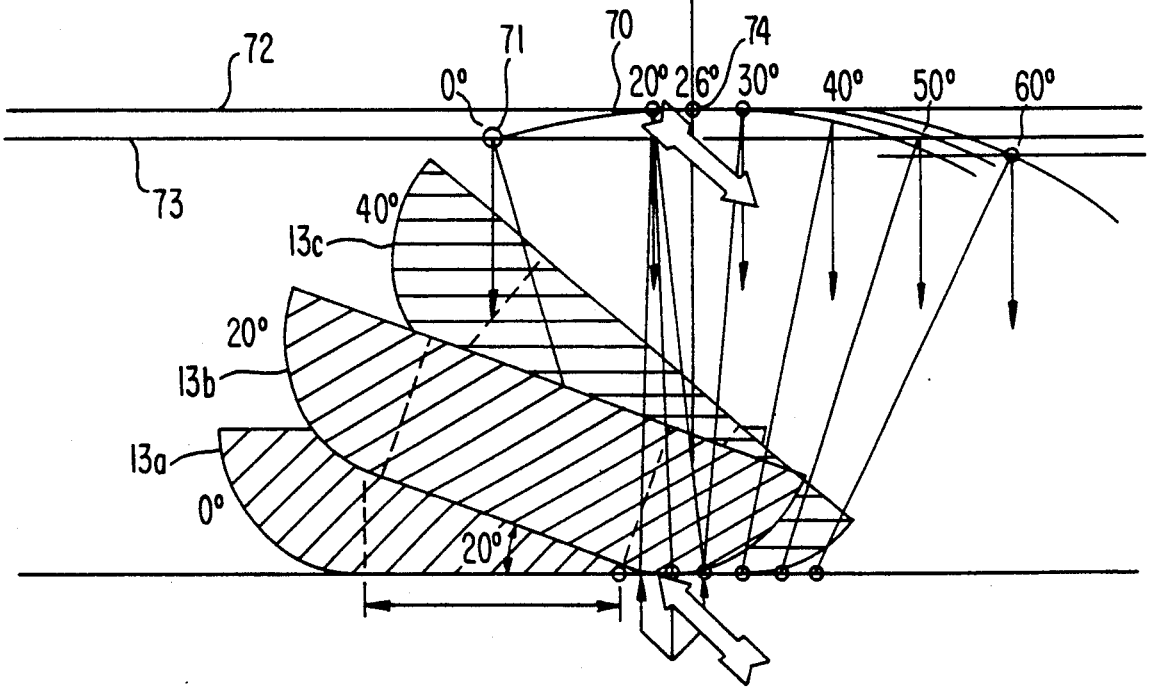
FIG. 14 is a diagrammatic side cross-sectional view of forces which occur in the dynamic and static cases for the shoe sole according to the invention.

FIG. 14 illustrates in a curve 70 the range of motion of the ankle center of gravity from the shoe according to the invention. Thus, in a static case where the center of gravity 71 lies at approximately the mid-point of the sole, and assuming that the shoe inverts from 0° to 20° to 40°, as shown in progressions **13*a*, 13*b* and 13*c*, the locus of points of motion for the center of gravity thus defines the curve 70 wherein the center of gravity 71 traverses between a high represented by the line 72 and a low represented by the line 73. For the embodiment shown, the shoe sole stability equilibrium point is at 26° (at point 74) and in no case is there a pivoting edge to define a rotation point as in the case of FIG. 2. The range of the vertical center of gravity motion between the lines 72 and 73** is much less than from a flared bottom shoe. The inherently superior stability of the design provides pronation control (or eversion), as well as lateral or inversion control.

Figure 15:
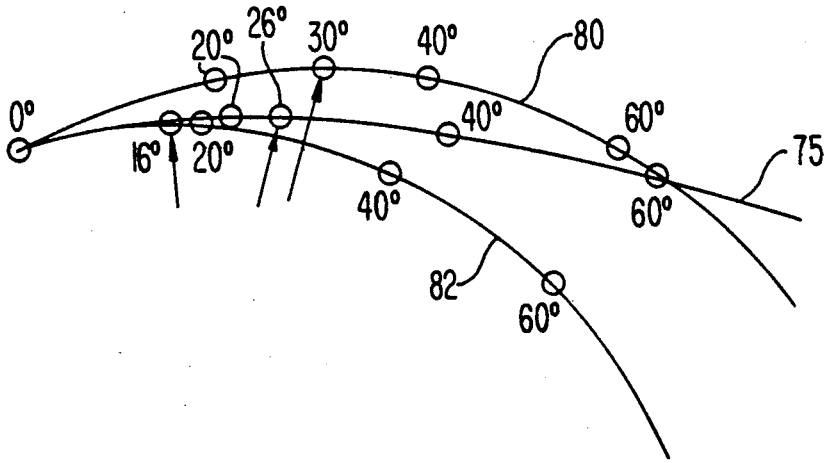
FIG. 15 is a diagrammatic view of a plurality of moment curves of the center of gravity for various degrees of inversion for the shoe sole according to the invention, and contrasted to the motions shown in FIG. 2.

FIG. 15 thus compares the range of motion of the center of gravity for the invention, as shown in curve 75, in comparison to curve 80 for the conventional wide heel flare and a curve 82 for a narrow rectangle the width of a human heel. Since the shoe stability limit is 26° in the inverted mode, the shoe sole is stable at the 20° approximate barefoot inversion limit. That factor, and the broad base of support rather than the sharp bottom edge of the prior art, make the contour design stable even in the dynamic case as shown in FIGS. 14 and 15 and permit the inherent stability of the barefoot to dominate without interference, unlike existing designs. The stability superiority of the contour side design is thus clear when observing how much flatter its center of gravity curve 71 is than in existing favored design 80. The curve demonstrates that the contour side design has the same efficient natural 7° inversion/eversion motion as the narrow rectangle design the width of a human heel, much more efficient than the conventional wide flare design; at the same time, the contour side design is more stable in extremis than either conventional design.

Figure 16A:
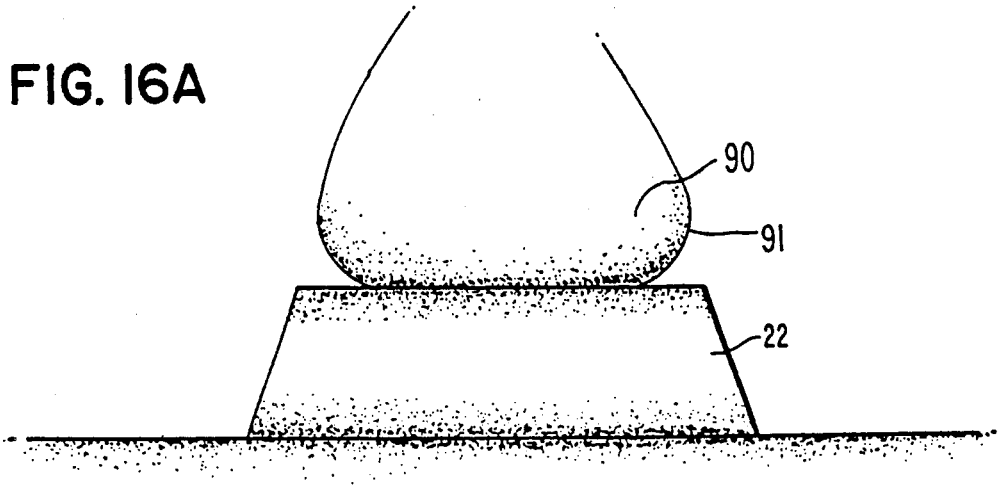
FIG. 16 shows, in FIGS. 16A and 16B, a rear diagrammatic view of a human heel, as relating to a conventional shoe sole (FIG. 16A) and to the sole of the invention (FIG. 16B)

FIG. 16A illustrates, in a pictorial fashion, a comparison of a cross section of a conventional shoe with a cross section of a shoe according to the invention when engaging a heel. As seen in FIG. 16A, when the heel 90 of the wearer engages an upper surface of the shoe sole 22, the shape of the heel and the shoe sole is such that the shoe sole 22 conforms to the contour of the ground and not to the contour of the sides of the foot. As a result, the shoe sole cannot follow the natural 7° inversion/eversion motion of the foot. This lack of cooperation represents the fundamental misconception of the currently-available designs.

Figure 16B:
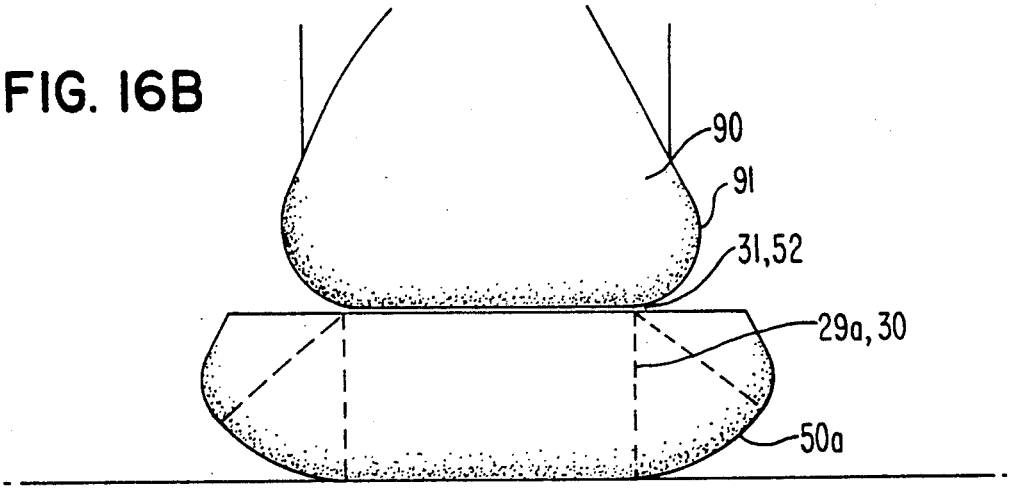

That misconception, on which existing shoe designs are based, is that, while shoe uppers are considered as a part of the foot and conform to the shape of the foot, the shoe sole is functionally conceived of as a part of the ground and is therefore shaped like the ground, rather than the foot. In contrast, the new design, as illustrated in FIG. 16B, illustrates a correct conception of the shoe sole as a part of the foot and an extension of the foot, with shoe soles sides contoured much like those of the foot. With the correct basic conception, as described in connection with this invention, the shoe can move naturally with the foot, instead of restraining it, so both natural stability and natural efficient motion coexist in the same shoe, with no inherent contradiction in design goals.

Thus, the contoured shoe design of the invention brings together in one shoe design the cushioning and protection typical of modern shoes, with the freedom from injury and functional efficiency, meaning speed, and/or endurance, typical of barefoot stability and natural freedom of motion. Significant speed and endurance improvements are anticipated, based on both improved efficiency and on the ability of a user to train harder without injury.

FIG. 16B also illustrates, in convenient fashion, the relative location of the points 31 (FIGS. 3 and 5) and 52 (FIG. 12) on the upper surface of the sole, relative to the load-bearing portion of the sole of the foot. These figures also illustrate that the shoe heel cannot pivot ±7 degrees with the prior art shoe of FIG. 16A. In contrast the shoe heel in the embodiment of FIG. 16B pivots with the natural motion of the foot heel.

Figure 17:
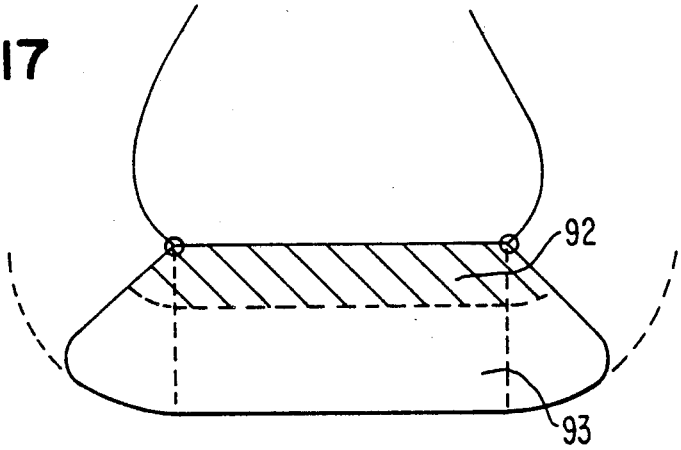
FIG. 17 illustrates, in a rear view, an application of the sole according to the invention to a shoe to provide an aesthetically pleasing and functionally effective design.

FIG. 17 shows, in a rear cross sectional view, the application of the invention to a shoe to produce an aethetically pleasing and functionally effective design. Thus, a practical design of a shoe incorporating the invention is feasible, even when applied to shoes incorporating heel lifts 92 and a combined midsole and outersole 93. Thus, use of a sole surface and sole outer contour which track the theoretically ideal stability plane does not detract from the commercial appeal of shoes incorporating the invention.

Figure 18A:
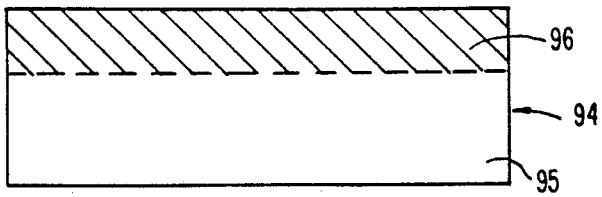
FIG. 18 illustrates, in FIGS. 18A–18C, heel cross-sectional views of a conventional street shoe (FIG. 18A), and the application of the invention shown in FIG. 18B to provide a street shoe (FIG. 18C) with a correctly contoured sole according to the invention.
Figure 18B:
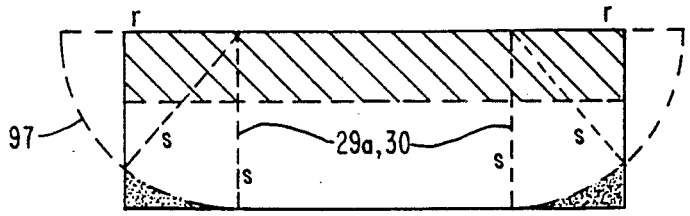
Figure 18C:
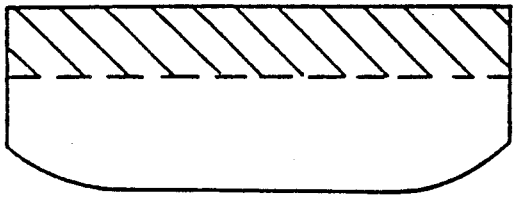

FIG. 18, in FIGS. 18A-14 18C, shows a development of a street shoe with a contoured sole incorporating the features of the invention. FIG. 18A shows a heel cross section of a typical street shoe 94 having a sole portion 95 and a heel lift 96. FIG. 18B develops a theoretically ideal stability plane 97, as described above, for such a street shoe, wherein the radius r of curvature of the sole edge is equal to the shoe sole thickness. The resulting street shoe with a correctly contoured sole is thus shown in FIG. 18C, with a reduced side edge thickness for a less bulky and more aesthetically pleasing look. Accordingly, the invention can be applied to an unconventional heel lift shoe, like a simple wedge, or to the most conventional design of a typical walking shoe with its heel separated from the forefoot by a hollow under the instep. For the embodiment of FIG. 18, the theoretically ideal stability plane is determined by the shoe sole width and thickness, using an optimal human heel width as measured along the width of the hard human heel tissue on which the heel is assumed to rotate in an inversion/eversion mode. With the invention, as so applied, the stability and natural motion of any existing shoe design, except high heels or spike heels, can be significantly improved by contouring the bottom sole to the theoretically ideal stability plane.

Figure 19A:
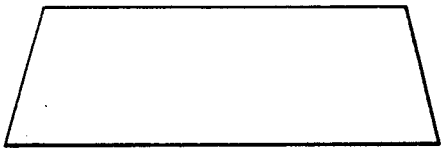
FIG. 19 shows, in FIGS. 19A–19C, a heel cross-sectional view of a conventional racing shoe (FIG. 19A), and the application of the invention shown in FIG. 19B to provide a racing shoe (FIG. 19C) with a correctly contoured sole according to the invention.
Figure 19B:
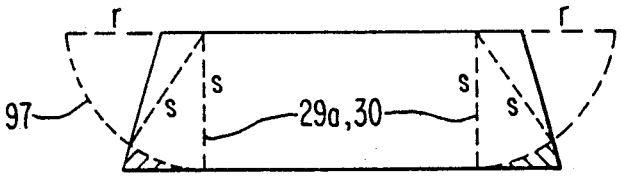
Figure 19C:
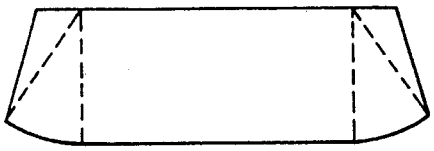

FIG. 19 is similar to FIG. 18 and illustrates the application of the invention to a typical competitive running shoe to produce a correctly contoured sole. Thus FIG. 19A shows a heel cross section of a conventional racing shoe to which the notions of the invention as seen in FIG. 19B are applied, to produce a modified racing shoe with a correctly contoured sole as shown in FIG. 19C.

Figure 20A:
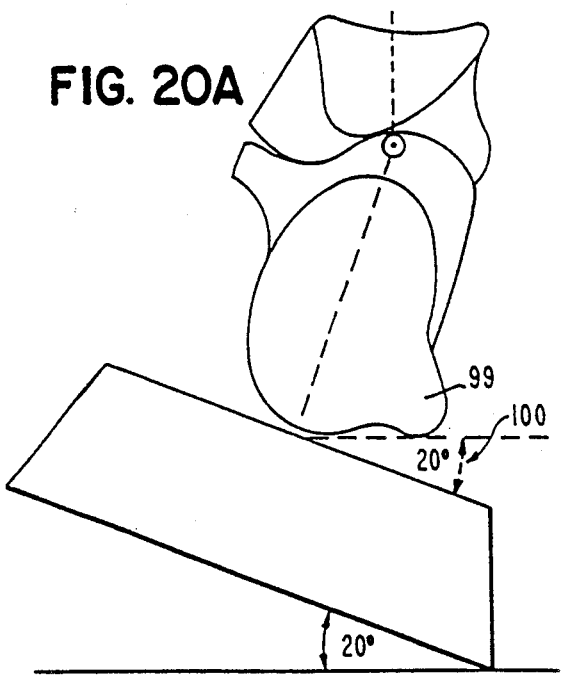
FIG. 20 shows, in a diagrammatic rear view, a relationship between the calcaneal tuberosity of the foot and the use of a wedge with the shoe of the invention.
Figure 20B:
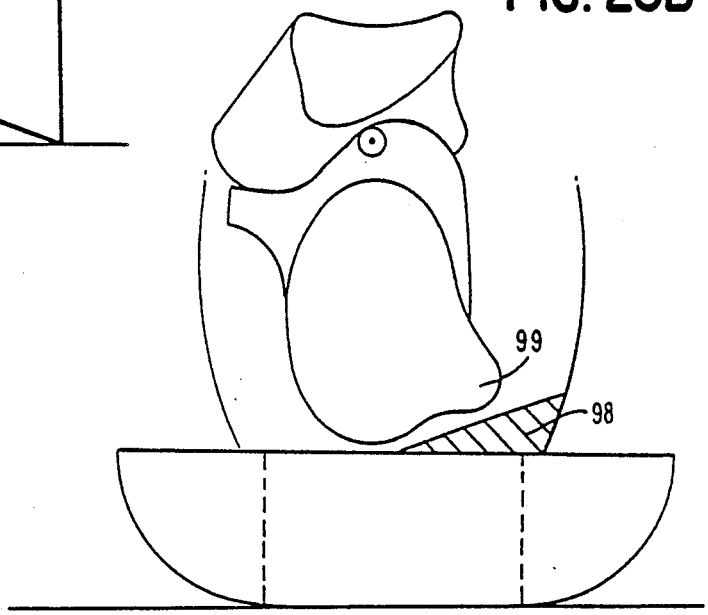

FIGS. 20A and 20B show the possible desirability of using wedge inserts 98 with the sole of the invention to support the calcaneal tuberosity. As seen in FIG. 20A, the calcaneal tuberosity 99 is unsupported when a shoe of the prior art is inverted through an angle of 20°. This is about the natural extreme limit of calcaneal inversion motion at which point the calcaneal tuberosity, located on the lateral side of the calcaneus, makes contact with the ground and restricts further lateral motion. When the conventional wide shoe sole reaches such an inversion limit, the sole leaves the calcaneal tuberosity 99 completely unsupported in the area 100 whereas when the foot is bare, the calcaneal tuberosity contacts the ground, providing a firm base of support. To address this situation, a wedge 98 of a relatively firm material, usually roughly equivalent to the density of the midsole and the heel lift, is located on top of the shoe sole under the insole in the lateral heel area to support the lateral calcaneal tuberosity. Thus, such a wedge support can also be used with the sole of the invention as shown in FIG. 20B. Usually, such a wedge will taper toward the front of the shoe and is contoured to the shape of the calcaneus and its tuberosity. If preferred, the wedge can be integrated with and be a part of a typical contoured heel of an insole.

Figure 21:
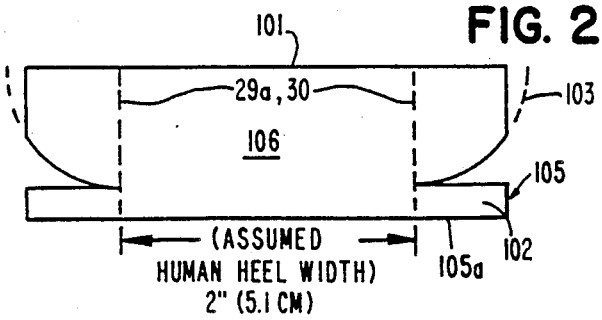
FIG. 21 illustrates an alternate embodiment of the invention wherein the sole structure deforms in use to follow a theoretically ideal stability plane according to the invention during deformation.
Figure 22:
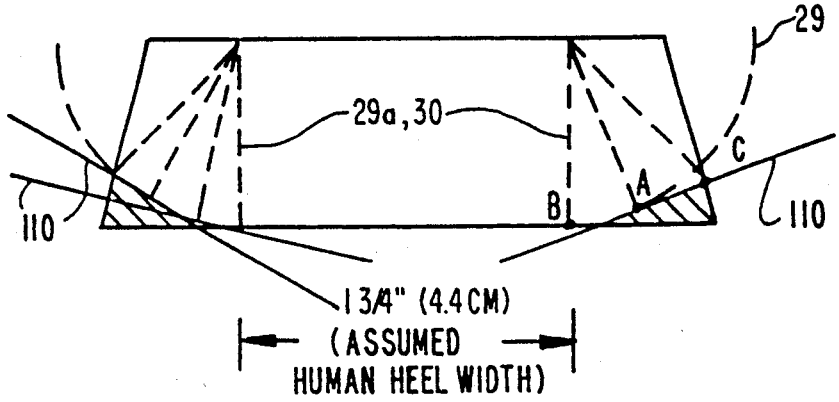
FIG. 22 shows an embodiment wherein the contour of the sole according to the invention is approximated by a plurality of chord segments.

The shoe sole according to the invention can be made by approximating the contours, as indicated in FIGS. 21 and 22. In the proposed approximation as seen in FIG. 21, the heel cross section includes a sole upper surface 101 and a sole edge surface 102 following the theoretically ideal stability plane 103. The sole edge surface 102 terminates in a laterally extending portion 105 joined to the heel 106. The laterally-extending portion 105 is made from a flexible material and structured to cause its lower surface 105*a* to terminate during deformation at the theoretically ideal stability plane. Thus, in a dynamic case, the outer edge contour assumes approximately the shape described above as a result of the deformation of the portion 105.

It is presently contemplated that the controlled or programmed deformation can be provided by either of two techniques. In one, the shoe sole sides, at especially the midsole, can be cut in a tapered fashion or grooved so that the bottom sole bends inwardly under pressure to the correct contour. The second uses an easily deformable material in a tapered manner on the sides to deform under pressure to the correct contour. While such techniques produce stability and natural motion results which are a significant improvement over conventional designs, they are inherently inferior to contours produced by simple geometric shaping. First, the actual deformation must be produced by pressure which is unnatural and does not occur with a bare foot and second, only approximations are possible by deformation, even with sophisticated design and manufacturing techniques, given an individual's particular running gait or body weight. Thus, the deformation process is limited to a minor effort to correct the contours from surfaces approximating the ideal curve in the first instance.

The theoretically ideal stability curve 29 can also be approximated by a plurality of line segments 110, such as tangents or chords, shown in FIG. 22. While a single flat plane approximation may correct many of the biomechanical problems occurring with existing designs, because it removes most the area outside of the theoretically ideal stability plane 29, the single plane approximation is presently not preferred, since it is the least optimal. By increasing the number of flat planar surfaces formed, the curve more closely approximates the exact, ideal design contour, as previously described.

Figure 23:
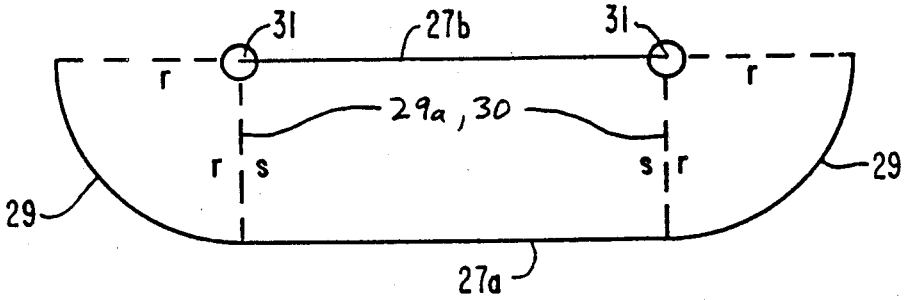
FIG. 23 shows in a diagrammatic view the theoretically ideal stability plane.

FIG. 23 shows in frontal plane cross section the essential concept underlying this invention, the theoretically ideal stability plane, which is also theoretically ideal for efficient natural motion of all kinds, including running, jogging or walking.

For any particular individual (or size average of individuals), the theoretically ideal stability plane is determined, first, by the given shoe sole thickness (s), and, second, by the frontal plane cross section width of the individual's load-bearing footprint 27*b*, which is defined as the upper surface of the shoe sole that is in physical contact with and supports the human foot sole.

The theoretically ideal stability plane is composed conceptionally of two parts. The first part is a line segment 27*a* of equal length and parallel to 27*b* at a constant distance (s) equal to shoe sole thickness. This corresponds to a conventional shoe sole directly underneath the human foot. The second part is a quadrant edge 29 or quarter of a circle (which may be extended up to a half circle) at each side of the first part, line segment 27*a*. The quadrant edge 29 is at radius (r), which is equal to shoe sole thickness (s), from a center of rotation 31, which is the outermost point on each side of the line segment 27*b*. In summary, the theoretically ideal stability plane is the essence of this invention because it is used to determine a geometrically precise bottom contour of the shoe sole. And, this invention specifically claims the exactly determined geometric relationship just described. It can be stated unequivocally that any shoe sole contour, even of similar quadrant contour, that exceeds the theoretically ideal stability plane will restrict natural foot motion, while any lesser contour will degrade natural stability.

That said, it is possible that an adjustment to a definition included in the preceding conception might be made at some point in the future not on a theoretical basis, but an empirical one. It is conceivable that, in contrast to the rest of the foot, a definition of line segment 27*b* at the base of the human heel could be the width of the very hard tissue (bone, cartilage, etc.), instead of the load-bearing footprint, since it is possible that the heel width is the geometrically effective pivoting width which the shoe heel must precisely equal in order to pivot optimally with the human heel. For a typical male size 10D, that very hard tissue heel width is 1.75 inches, versus 2.25 inches for the load-bearing footprint of the heel.

It is an empirical question, though, not a question of theoretical framework. Until more empirical work is done, optimal heel width must be based on assumption. The optimal width of the human heel pivot is, however, a scientific question to be determined empirically if it can be, not a change in the essential theoretically ideal stability plane concept claimed in the invention. Moreover, the more narrow the definition, the more important exact fit becomes and relatively minor individual misalignments could produce pronation control problems, for example, that negate any possible advantage.

Thus, it will clearly be understood by those skilled in the art that the foregoing description has been made in terms of the preferred embodiment and various changes and modifications may be made without departing from the scope of the present invention which is to be defined by the appended claims.

What is claimed is:

1. A shoe sole construction for a shoe, such as a street or athletic shoe, comprising:

a sole having a sole portion and a contoured side portion;

said sole portion including a substantially flat foot support surface and defined by a substantially constant frontal plane thickness;

said side portion being defined at least in part by a frontal plane arc of a substantially circular surface having a radius equal to the thickness of said sole portion and having the center of said radius lying at a point on a plane defined by an upper surface of said sole;

said thickness of said sole portion varying in a sagittal plane and being greater in the heel area than in the forefoot area;

said radius defining the arc of said side portion correspondingly varying directly and equally with the thickness of said sole portion; and said contoured side portion extending along at least a lateral or medial heel portion of said sole portion.

2. The sole construction as set forth in claim 1, wherein said thickness which defines said radius lies at about the edge of said sole portion.

3. The sole construction as set forth in claim 1, wherein said sole portion further includes a ground-engaging portion opposite to said foot support surface, wherein said curved surface of said side portion merges with said ground-engaging portion from opposed sides to define a theoretically ideal stability plane.

4. The sole construction as set forth in claim 1, wherein said sole portion and said side portion are integrally formed into a unitary structure.

5. The sole construction as set forth in claim 1, wherein center of the arc defined by the radius lies at a point on the upper surface of the sole where an outer portion of a wearer's heel stationarily contacts said foot support portion.

6. The sole construction as set forth in claim 1, wherein said shoe is a street shoe, an athletic shoe, a running shoe, or a racing shoe.

7. The sole construction as set forth in claim 1, further including an upper connected to said sole.

8. The sole construction as set forth in claim 1, wherein the edge portion further includes a second surface joining the arc, the second surface lying at an angle relative to a plane defined by an upper surface of the sole portion.

9. The sole construction as set forth in claim 1, wherein the sole portion is defined by an upper surface terminating in opposed sole edges about perpendicular to said upper surface, an edge of side edge portion being secured to said sole edge.

10. The sole construction as set forth in claim 1, wherein the sole portion is made from a material having about a uniform density.

11. The sole construction as set forth in claim 1, wherein the side portion extends substantially entirely about the horizontal contour of the sole portion at an edge thereof.

12. The sole construction as set forth in claim 1, wherein the side portion extends along the horizontal contour of the sole portion in a number of discrete parts.

13. The sole construction as set forth in claim 1, wherein the side portion extends only partly about the horizontal contour of the sole portion at an edge thereof.

14. The sole construction as set forth in claim 1, wherein a center of the arc defined by the radius lies at about a constant distance from the ground during sideways tilting rotation of said shoe sole.

15. The sole construction as set forth in claim 1, wherein said arc of said side portion is approximated by at least a pair of flat planar surfaces defining said contoured edge.

16. The sole construction as set forth in claim 1, wherein said arc of said side portion is approximated by the construction of said shoe sole which, when deformed under normal load during use by its wearer, approximates said radius.

17. The shoe sole construction as set forth in claim 1 wherein said arc of said side portion is approximated by one or more flat planar surfaces defining said contoured side portion.

18. The shoe sole construction as set forth in claim 1 wherein said sole portion comprises a foot support surface, and wherein an outer edge of said foot support surface of said sole portion coincides with an outer edge of a conventional shoe sole directly underneath a wearer's foot.

19. The shoe sole construction as set forth in claim 1 wherein said sole portion comprises a foot support surface, where an outer edge of said foot support surface coincides with an outer edge of a wearer's load bearing footprint.

20. The shoe sole construction as set forth in claim 1 wherein said sole portion comprises a foot support surface with at least at a heel portion of said sole portion, wherein said foot support surface coincides with very hard tissue of a foot heel of a wearer of the shoe.

21. The shoe sole construction as set forth in claim 1 wherein said sole portion comprises a foot support surface with at least at a heel portion of said sole portion, wherein said foot support surface coincides with an empirically-determined optimal width of a human heel pivot.

22. The shoe sole construction as set forth in claim 1 wherein the thickness of said sole portion is measured by including all sole material.

23. The shoe sole construction as set forth in claim 1 wherein said sole portion comprises a foot support surface, said construction further including heel counter and other motion control means which effectively position and secure a foot of a wearer onto said sole portion of the shoe sole.

24. The shoe sole construction as set forth in claim 1 wherein said contoured side portion is truncated or tapered.

25. The sole construction as set forth in claim 1, wherein the sole portion is defined by an upper surface which is coincident with an outer edge contour in a horizontal plane which is defined by load-bearing potions of a foot sole.

26. The sole construction as set forth in claim 7 wherein the radius intersects said foot support surface of said sole portion at about the location where said upper connects to said sole portion.

27. The sole construction as set forth in claim 7 further including a wedge insert to support the calcaneal tuberosity.

28. The shoe sole construction as set forth in claim 13 wherein the edge portion extends along partly about the horizontal contour of the sole portion for at least a portion of the heel at an edge thereof.

29. The sole construction as set forth in claim 14 where the locus of said center lies along a line which lies at a constant distance from the ground.

30. The shoe sole construction as set forth in claim 17 wherein said arc is approximated by at least a pair of said flat planar surfaces.

31. The shoe sole construction as set forth in claim 22 wherein said all sole material includes sole material from the top surface in contact with a foot sole of a wearer to a lower ground-contacting surface of the shoe sole lying along a theoretically ideal stability plane.

32. The shoe sole construction as set forth in claim 27 wherein said wedge insert is about a 20° degree wedge insert and said calcaneal tuberosity is the lateral calcaneal tuberosity.

33. A shoe, such as a street or athletic shoe, comprising:

an upper; and a sole secured to said upper and having a contoured side along at least a lateral or medial heel portion of said sole, said contoured side defined in about frontal plane cross sections at least in part by a portion of a substantially circular arc having a radius equal to a thickness of said sole and having a center of said radius at a point on about a plane defined by an upper surface of said sole, said sole thickness being greater in the heel than in the forefoot.

34. The shoe as set forth in claim 33, wherein said contoured side of said sole is defined at least in part by a portion of a theoretically ideal stability plane, is defined by a radius about equal to a thickness of said sole and having an end of said radius at a point about on a plane defined by a upper surface of said sole.

35. The shoe as set forth in claim 33 wherein the thickness of the sole varies and the radius defining the arc of said side portion correspondingly varies about directly and equally with the thickness of the sole portion.

36. The shoe as set forth in claim 33 wherein said thickness of said sole is measured by including all sole material.

37. The shoe as set forth in claim 36 wherein said all sole material includes sole material from a top surface in contact with the foot sole to the lower surface of the shoe sole contacting the ground, and lying in the theoretically ideal stability plane.

38. A shoe sole with a sole side along at least a portion of said sole, said sole side defined at least in part by at least a portion of a quadrant with a radius substantially equaling the thickness of said sole at about an outer edge, exclusive of said side, with an inner edge of said quadrant lying perpendicular to an upper surface of said sole and an outer edge of said quadrant coinciding with said upper sole surface.

39. The sole construction as set forth in claim 38, wherein said sole side extends along at least a lateral or medial heel portion of said sole and said heel portion is thicker than the forefoot.

40. The shoe as set forth in claim 38 wherein said inner edge of said quadrant lying perpendicular to an upper surface of the sole has a length equal to the thickness of said sole as measured by including all sole material between said upper surface of said sole contacting the wearer's foot and a lower surface contacting the ground.

41. The sole construction as set forth in claim 38, wherein said side of said sole is defined at least in part by a portion of a theoretically ideal stability plane.

42. The sole construction as set forth in claim 38, wherein said outer edge extends to lie at an angle relative to the sole upper surface.

43. The shoe as set forth in claim 40 wherein a radius of said quadrant is defined by a thickness of a sole of the shoe, said radius varying about directly and equally with the thickness of said sole portion.

44. A shoe sole construction for a shoe, such as a street or athletic shoe, comprising:

a sole having a sole portion and a contoured side portion extending along at least a portion of said sole portion;

said sole portion including a substantially flat foot support surface and defined by a substantially constant frontal plane thickness;

said side portion being defined at least in part by a frontal plane arc of a substantially circular surface having a radius equal to said thickness of said sole portion and the center of said radius lying at a point on a plane defined by an upper surface of said sole.

45. The shoe sole construction for a shoe as set forth in claim 44 wherein said thickness which defines said radius lies at about the edge of said sole portion.

46. The shoe sole construction for a shoe as set forth in claim 44 wherein said sole portion further includes a ground-engaging portion opposite to said foot support surface, wherein said circular surface of said side portion merges with said ground engaging portion from opposed edges to define a theoretically ideal stability plane.

47. The shoe sole construction for a shoe as set forth in claim 44 wherein said sole portion and said side portion are integrally formed into a unitary structure.

48. A shoe sole construction for a shoe, such as a running shoe, comprising:

a sole having a sole portion and a contoured edge portion extending along at least a portion of said sole portion;

said sole portion including a foot support surface and defined by a thickness;

said edge portion being defined at least in part by an arc of a curved surface having a radius equal to the thickness of said sole portion, said edge portion further including a second surface joining the arc, the second surface lying about in a plane defined by an upper surface of the sole portion.

49. The shoe sole construction as set forth in claim 48, wherein said contoured edge portion is truncated or tapered.

50. The shoe sole construction as set forth in claim 48 wherein the thickness of the sole portion varies and the radius defining the arc of said edge portion correspondingly varies with the thickness of the sole portion.

51. The shoe sole construction as set forth in claim 50 wherein the radius correspondingly varies about directly and equally with the thickness of the sole portion.

52. A shoe sole construction for a shoe, such as a running shoe, comprising:

a sole having a sole portion and a contoured edge portion extending along at least a portion of said sole portion:

said sole portion including a foot support surface and defined by a thickness:

said edge portion being defined at least in part by an arc of a curved surface having a radius equal to the thickness of said sole portion, wherein the thickness of the sole portion varies and the radius defining the arc of said edge portion correspondingly varies with the thickness of the sole portion.

53. The shoe sole construction as set forth in claim 52 wherein said curved surface is a circle.

54. The shoe sole construction as set forth in claim 52 wherein the radius correspondingly varies about directly and equally with the thickness of the sole portion.

* * * * *